US012514372B2

(12) United States Patent
Zhu

(10) Patent No.: US 12,514,372 B2
(45) Date of Patent: Jan. 6, 2026

(54) TELESCOPIC FOLDING CHAIR

(71) Applicant: Zhejiang Sunshine Leisure Products Co., Ltd., Jinhua (CN)

(72) Inventor: Xiaohui Zhu, Jinhua (CN)

(73) Assignee: Zhejiang Sunshine Leisure Products Co., Ltd., Jinhua (CN)

( * ) Notice: Subject to any disclaimer, the term of this patent is extended or adjusted under 35 U.S.C. 154(b) by 121 days.

(21) Appl. No.: 18/408,724

(22) Filed: Jan. 10, 2024

(65) Prior Publication Data

US 2024/0415286 A1 Dec. 19, 2024

(30) Foreign Application Priority Data

Jun. 15, 2023 (CN) ..... 202310711528.9

(51) Int. Cl.
*A47C 4/28* (2006.01)
*A47C 3/26* (2006.01)
*A47C 4/46* (2006.01)

(52) U.S. Cl.
CPC ..... *A47C 4/286* (2013.01); *A47C 3/26* (2013.01); *A47C 4/46* (2013.01)

(58) Field of Classification Search
CPC .. A47C 3/26; A47C 4/28; A47C 4/286; A47C 4/46
See application file for complete search history.

(56) References Cited

U.S. PATENT DOCUMENTS

| | | | | |
|---|---|---|---|---|
| 11,439,238 | B1 * | 9/2022 | Wang | A47C 4/286 |
| 11,844,439 | B1 * | 12/2023 | Wang | A47C 3/40 |
| 12,075,919 | B2 * | 9/2024 | Fulbright | A47C 4/286 |
| 2009/0174232 | A1 * | 7/2009 | Hoffman | A47C 4/42 108/115 |

FOREIGN PATENT DOCUMENTS

CN 111588211 A 8/2020

* cited by examiner

*Primary Examiner* — Milton Nelson, Jr.
(74) *Attorney, Agent, or Firm* — Cooper Legal Group, LLC

(57) ABSTRACT

A telescopic folding chair includes an upper mounting seat, a lower mounting seat and a cushion. The upper mounting seat is hinged with a plurality of support legs, and the lower mounting seat is hinged with a plurality of telescopic arm tube sets. The cushion is mounted on the telescopic arm tube sets. The lower mounting seat is provided with a plurality of inclined guide holes through which the support legs run. The upper mounting seat is rotatably provided with a rotary limiting mechanism, and the lower mounting seat is provided with an avoidance hole. A bottom of the rotary limiting mechanism is provided with a limiting head, and a bottom wall of the lower mounting seat is provided with a limiting portion corresponding to a periphery of the avoidance hole. The rotary limiting mechanism rotates to control the limiting head to be movably limited by the limiting portion.

12 Claims, 14 Drawing Sheets

TELESCOPIC FOLDING CHAIR

CROSS-REFERENCE TO RELATED APPLICATIONS

This application claims priority to Chinese Patent Application 202310711528.9, filed on Jun. 15, 2023, which is incorporated herein by reference.

TECHNICAL FIELD

The present invention relates to the technical field of telescopic folding chairs, and in particular to a telescopic folding chair.

BACKGROUND

In the prior art, Chinese Publication No. CN111588211A discloses a folding structure for a folding chair and a folding chair, which are convenient to operate. When unfolding or folding the folding chair, it is required to rotate the rotating member counterclockwise or clockwise all the time, and then sequentially drive the rotating member, a linkage member, a mounting frame, legs and telescopic tubes to move, so that all the telescopic tubes are unfolded for use or folded for storage. The folding chair in this technical solution is complex in structure, and is not fast and convenient enough to fold and unfold, and not stable enough, which affects the user experience.

SUMMARY

The present invention aims to provide a telescopic folding chair to solve the above technical problems.

In order to achieve the above objective, the technical solution of the present invention is as follows: A telescopic folding chair includes a mounting seat assembly and a cushion. The mounting seat assembly includes an upper mounting seat and a lower mounting seat correspondingly fitted up and down. A periphery of a bottom of the upper mounting seat is hinged with a plurality of support legs, and a periphery of a top of the lower mounting seat is hinged with a plurality of telescopic arm tube sets. The cushion is mounted on the plurality of telescopic arm tube sets. The lower mounting seat is provided with a plurality of inclined guide holes along a circumferential direction, and the support legs run through the inclined guide holes. The upper mounting seat is rotatably provided with a rotary limiting mechanism, and the lower mounting seat is provided with an avoidance hole. A bottom of the rotary limiting mechanism is provided with a limiting head, and the lower mounting seat is provided with a limiting portion corresponding to a periphery of the avoidance hole. The rotary limiting mechanism rotates to control the limiting head to be movably limited by the limiting portion. In an extended state, the limiting head runs through the avoidance hole and is rotatably limited by the limiting portion, and the upper mounting seat and the lower mounting seat abut against and lock each other up and down. In a retracted state, the limiting head is not rotatably limited by the limiting portion and exits the avoidance hole, and the upper mounting seat and the lower mounting seat are separated from each other.

Preferably, the telescopic arm tube sets each include an outer tube and an inner tube slidably and telescopically arranged in the outer tube. An elastic conical assembly and a push rod are arranged in the inner tube. The elastic conical assembly is elastically and telescopically arranged at a bottom of the inner tube, and a top end of the outer tube is sleeved with a limiting tube sleeve. An inner wall of the limiting tube sleeve is formed with an annular groove. The bottom of the inner tube is provided with an accommodating hole at a position corresponding to the elastic conical assembly. A rigid ball is arranged in the accommodating hole, and the push rod is configured to control the elastic conical assembly to extend and retract in the inner tube, such that the rigid ball is movably limited by the annular groove.

Preferably, the telescopic arm tube sets each include an outer tube and an inner tube slidably and telescopically arranged in the outer tube. A bottom of the inner tube is provided with an elastic member, the outer tube is provided with a slotted hole, and the elastic member is in a movable fit with the slotted hole such that the inner tube is slidably and telescopically arranged in the outer tube.

The present invention has the following beneficial effects:

The telescopic folding chair of the present invention includes the mounting seat assembly and the cushion. The mounting seat assembly includes the upper mounting seat and the lower mounting seat correspondingly fitted up and down. The periphery of the bottom of the upper mounting seat is hinged with the plurality of support legs, and the periphery of the top of the lower mounting seat is hinged with the plurality of telescopic arm tube sets. The cushion is mounted on the plurality of telescopic arm tube sets. The lower mounting seat is provided with the plurality of inclined guide holes along the circumferential direction, and the support legs run through the inclined guide holes. The upper mounting seat is rotatably provided with the rotary limiting mechanism, and the lower mounting seat is provided with the avoidance hole. The bottom of the rotary limiting mechanism is provided with the limiting head, and the lower mounting seat is provided with the limiting portion corresponding to the periphery of the avoidance hole. The rotary limiting mechanism rotates to control the limiting head to be movably limited by the limiting portion. In the extended state, the limiting head runs through the avoidance hole and is rotatably limited by the limiting portion, and the upper mounting seat and the lower mounting seat abut against and lock each other up and down. In the retracted state, the limiting head is not rotatably limited by the limiting portion and exits the avoidance hole, and the upper mounting seat and the lower mounting seat are separated from each other. The present invention is simple in structure, convenient to operate, quick to unfold for use and fold for storage, and high in stability, and thus, can be used by a user safely and conveniently, thereby ensuring the user experience. Moreover, the present invention occupies small space, and thus, is convenient store and carry.

Figure 1:
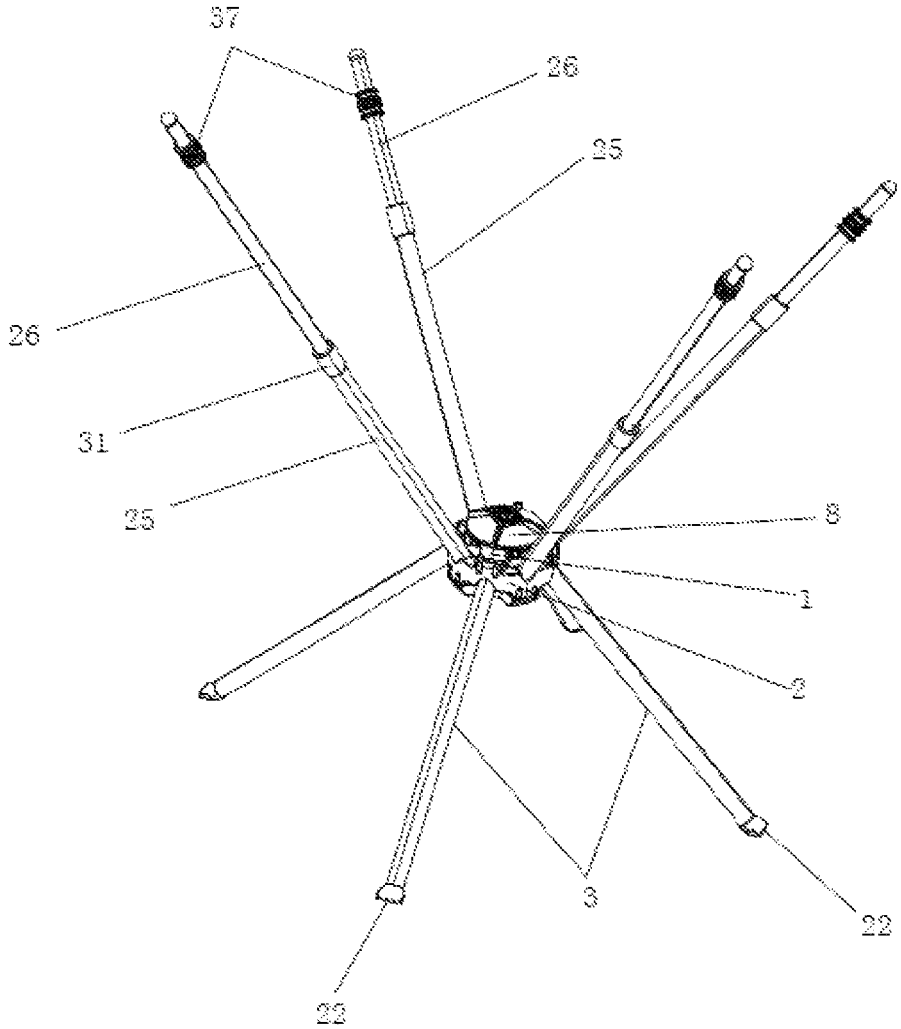
FIG. 1 is a schematic view of an embodiment of the present invention in an extended state.
Figure 2:
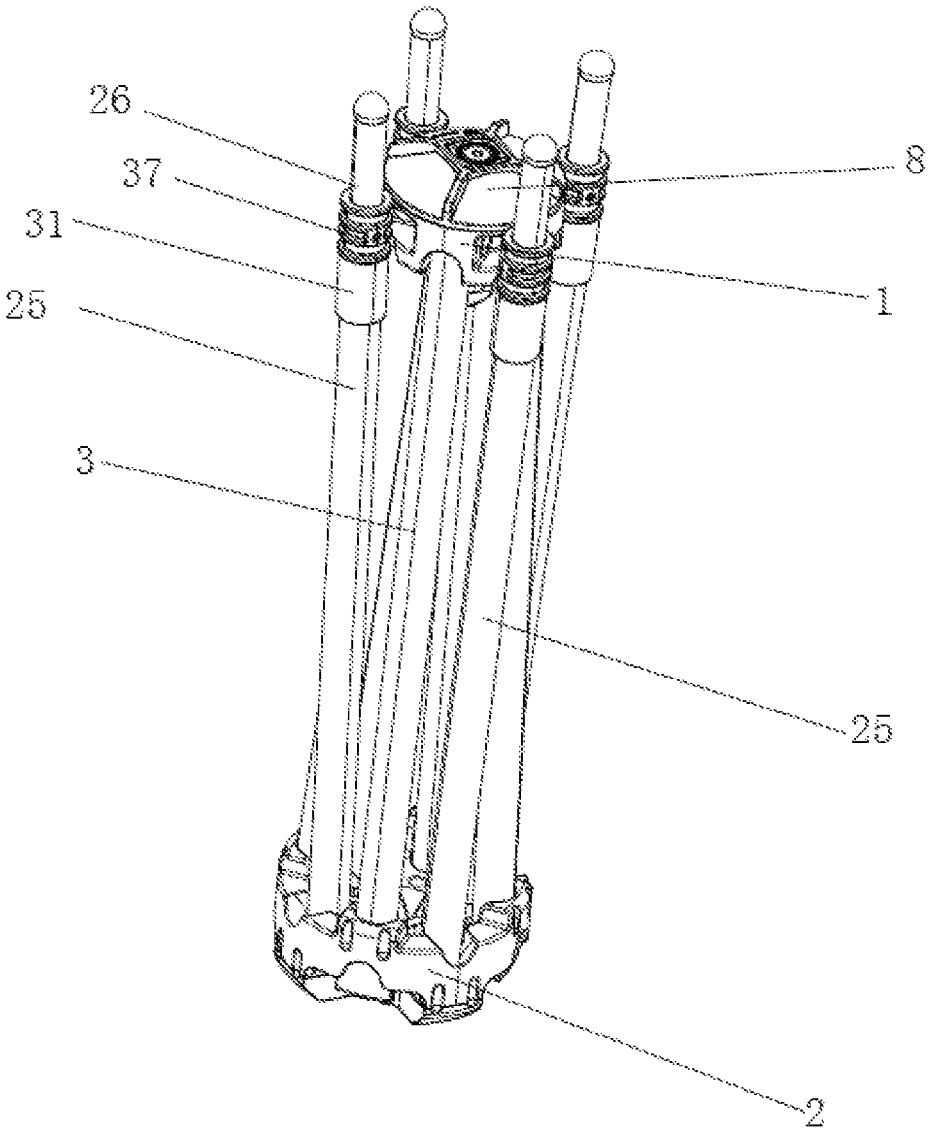
FIG. 2 is a schematic view of the embodiment of the present invention in a retracted state.
Figure 3:
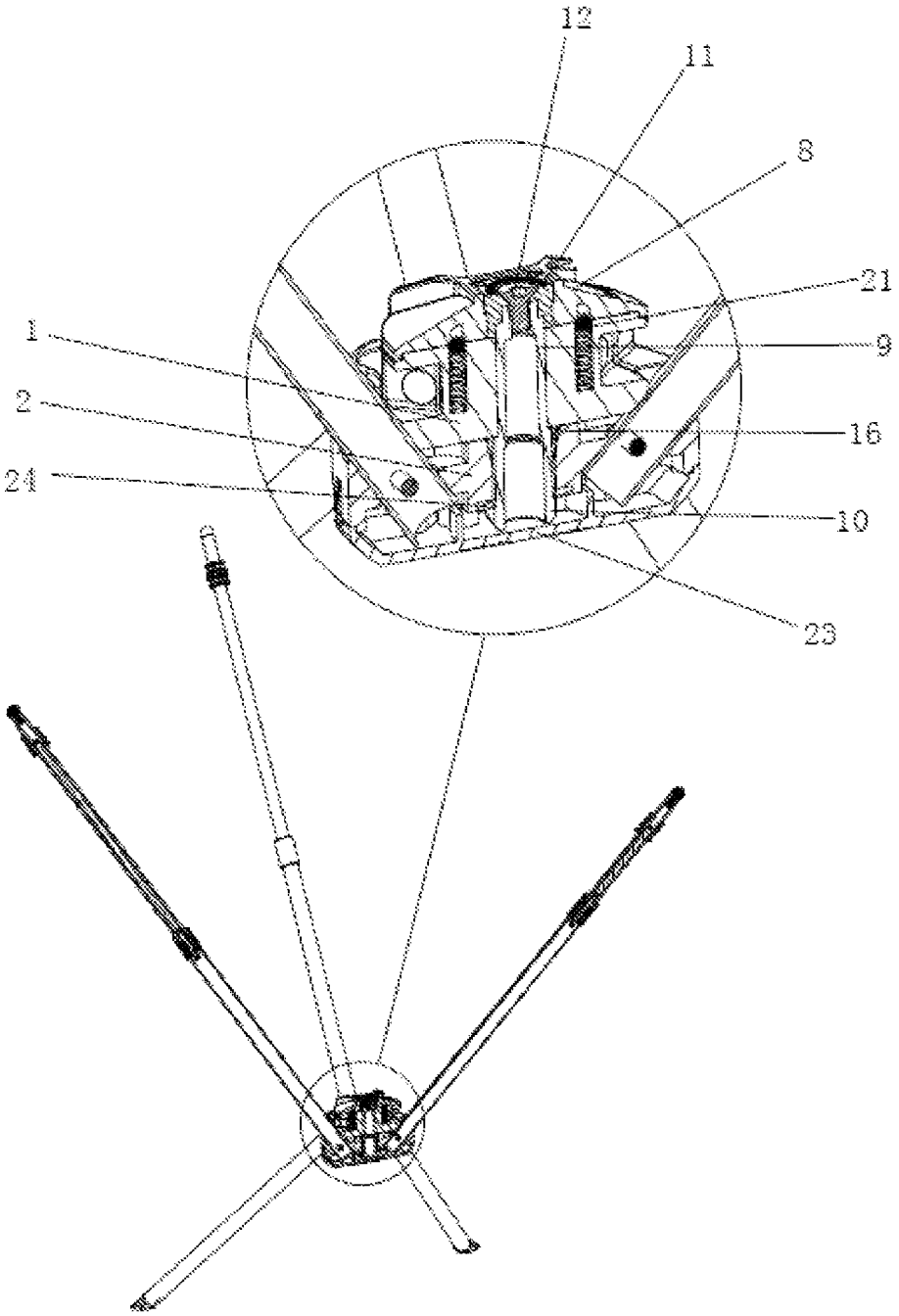
FIG. 3 is a cutaway view of the embodiment of the present invention in the extended state.
Figure 4:
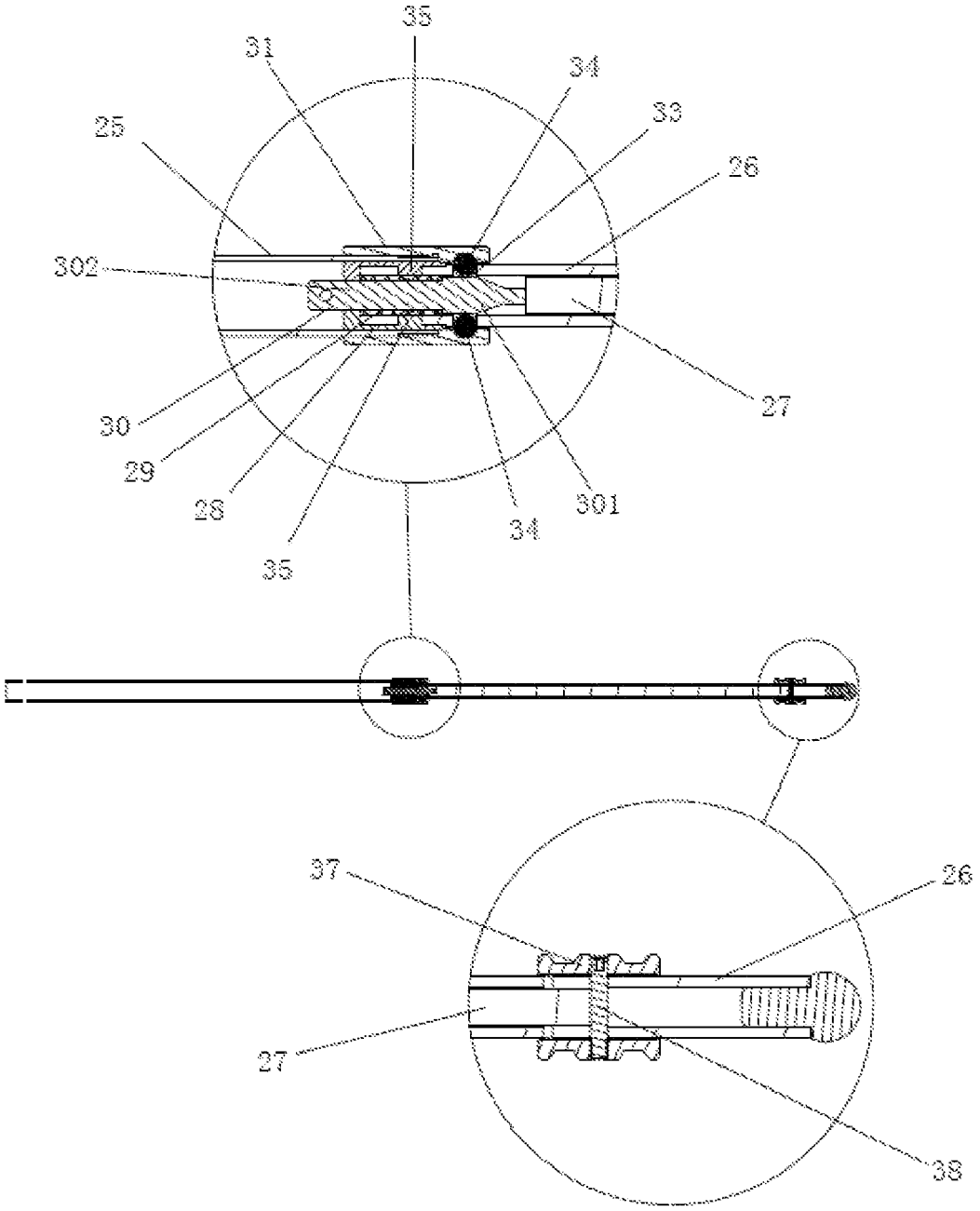
FIG. 4 is a cutaway view of a telescopic arm tube set of the embodiment of the present invention in the extended state.
Figure 5:
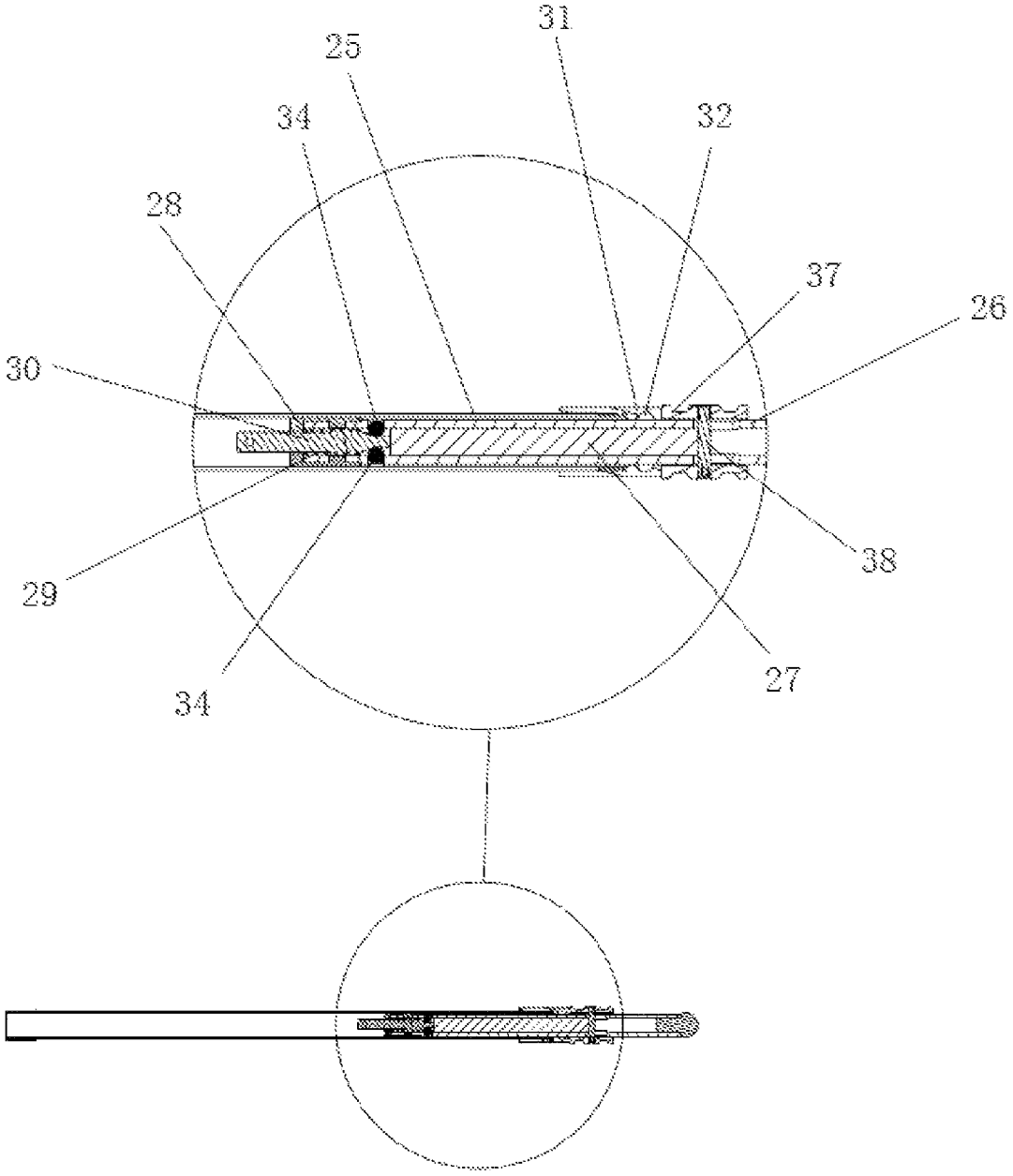
FIG. 5 is a cutaway view of the telescopic arm tube set of the embodiment of the present invention in the retracted state.
Figure 6:
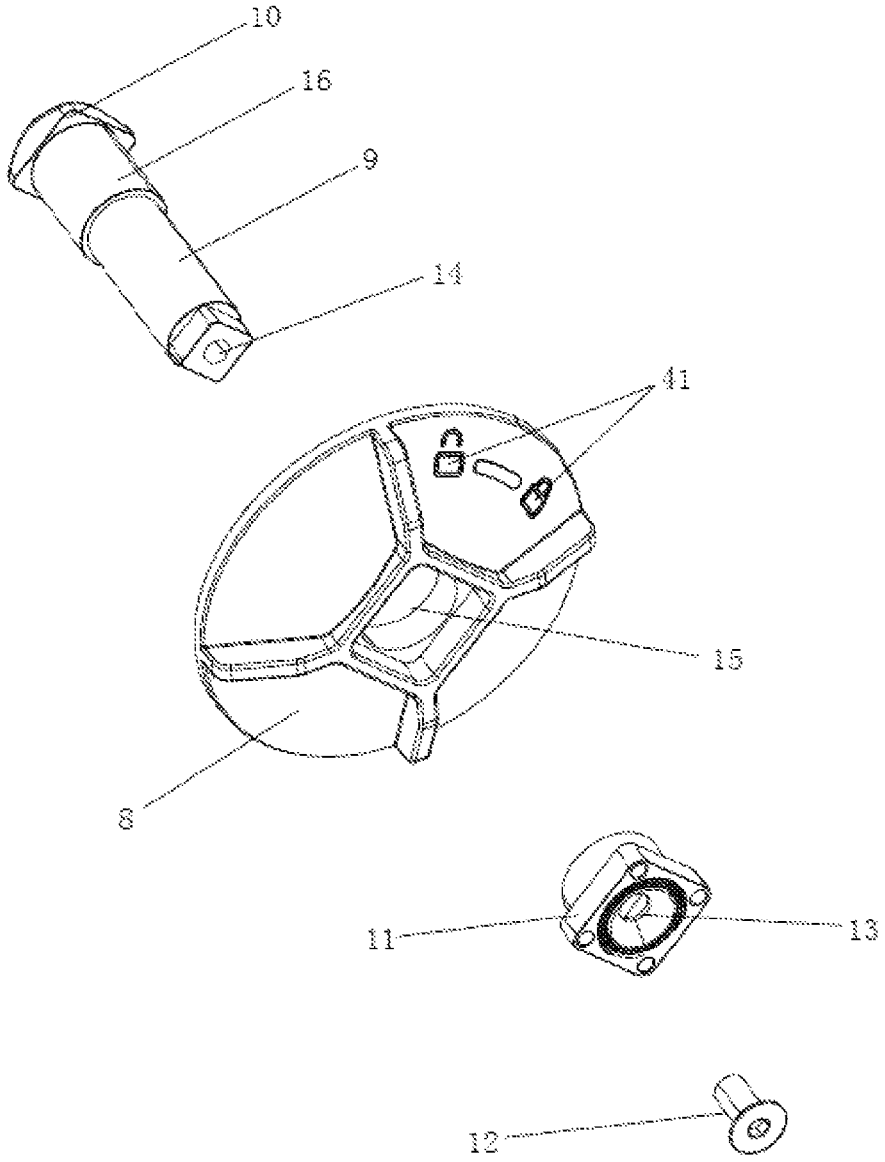
FIG. 6 is a schematic exploded view of a rotary limiting mechanism of the embodiment of the present invention.
Figure 7:
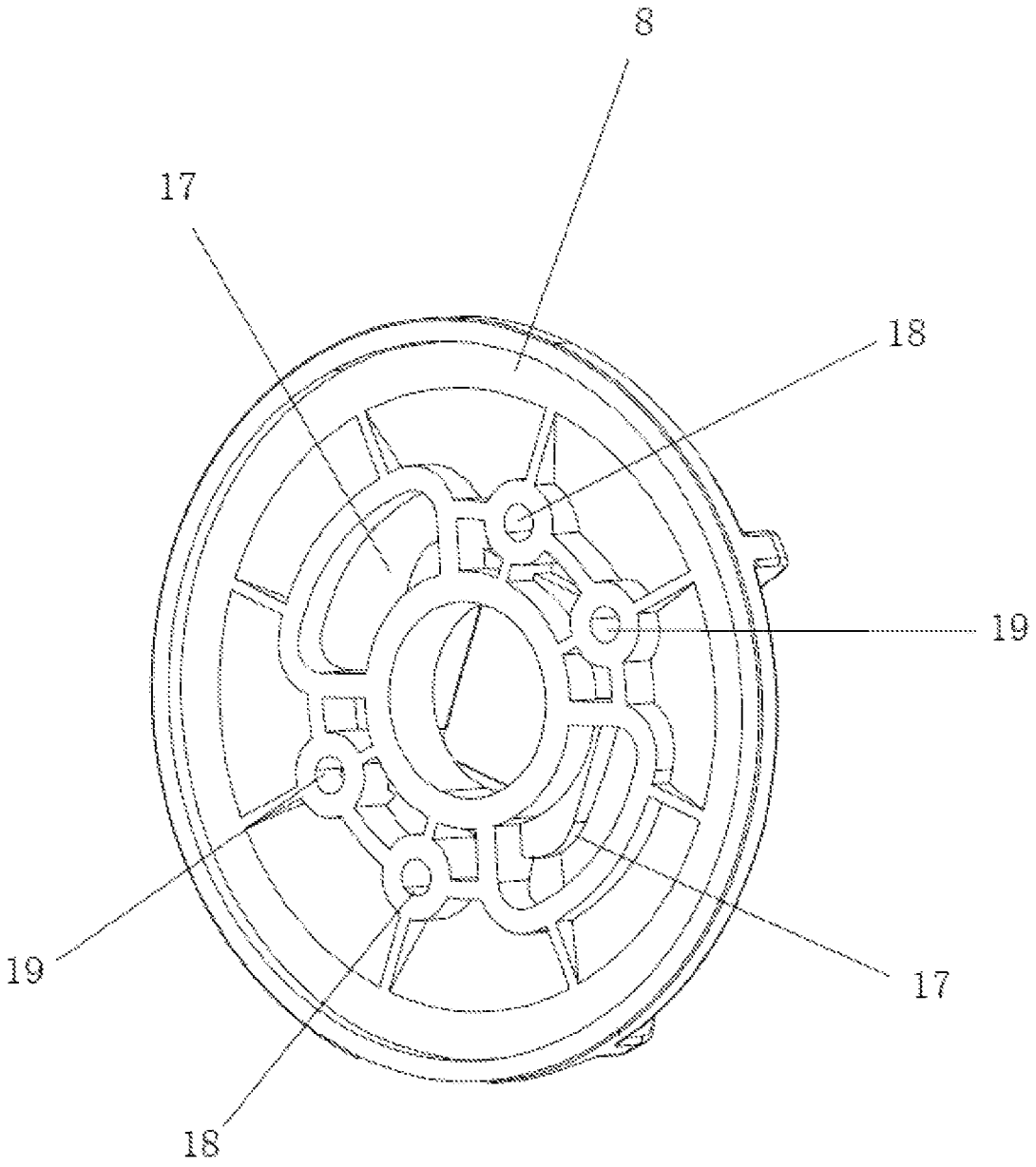
FIG. 7 is a bottom view of a lock/unlock screw cap of the embodiment of the present invention.
Figure 8:
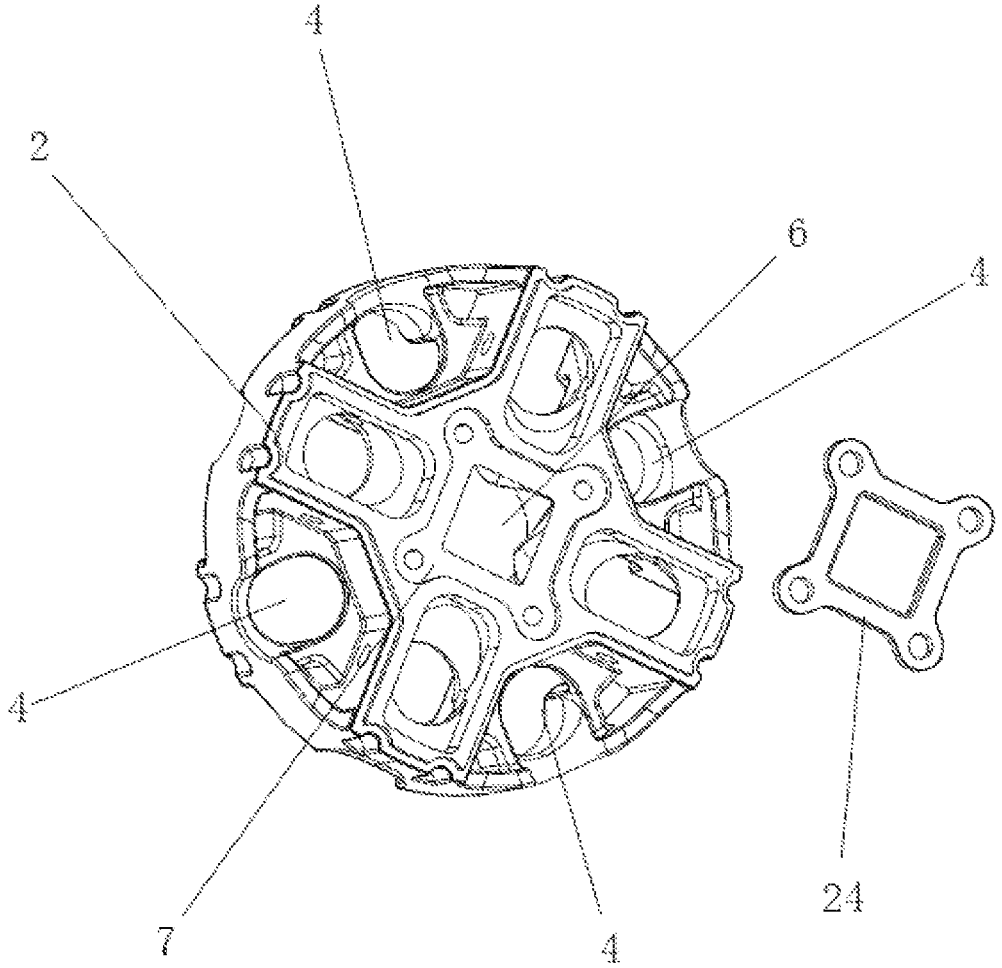
FIG. 8 is a schematic view of a lower mounting seat and a metal sheet of the embodiment of the present invention.
Figure 9:
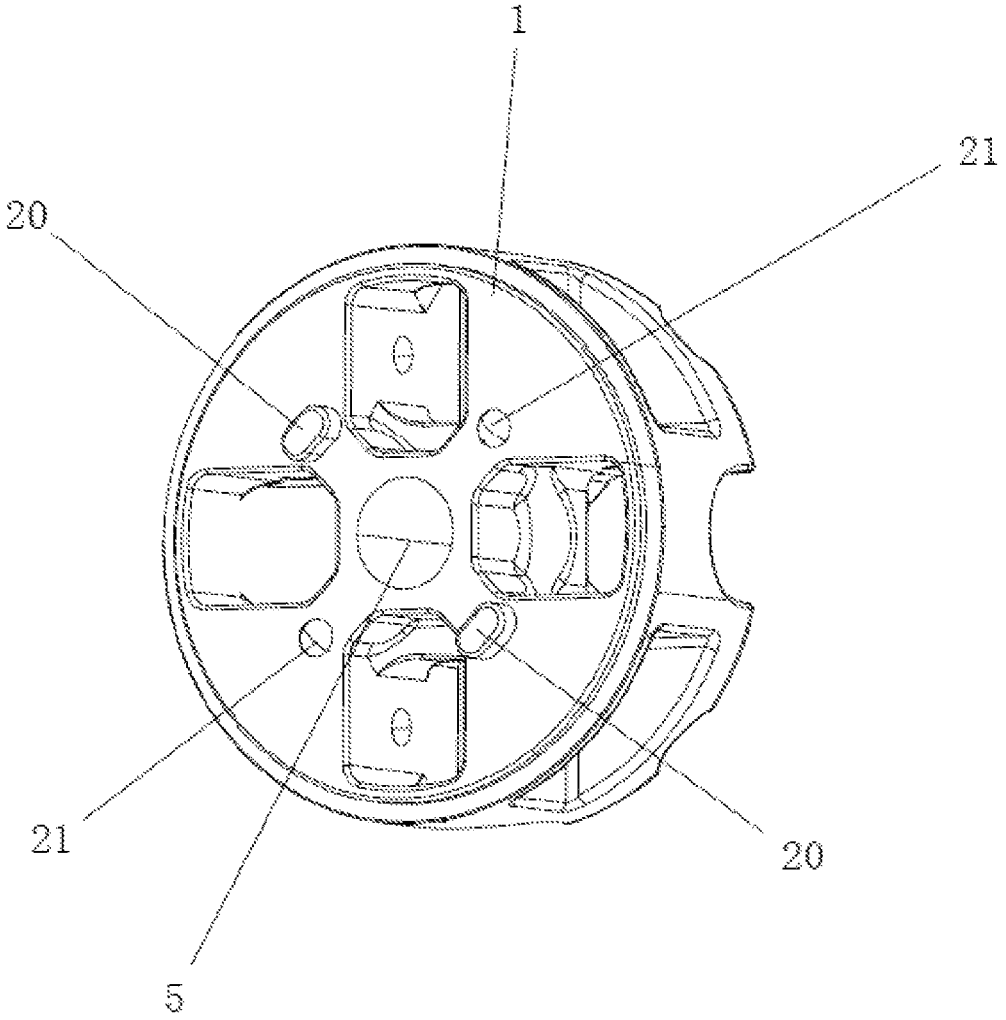
FIG. 9 is a top view of an upper mounting seat of the embodiment of the present invention.
Figure 10:
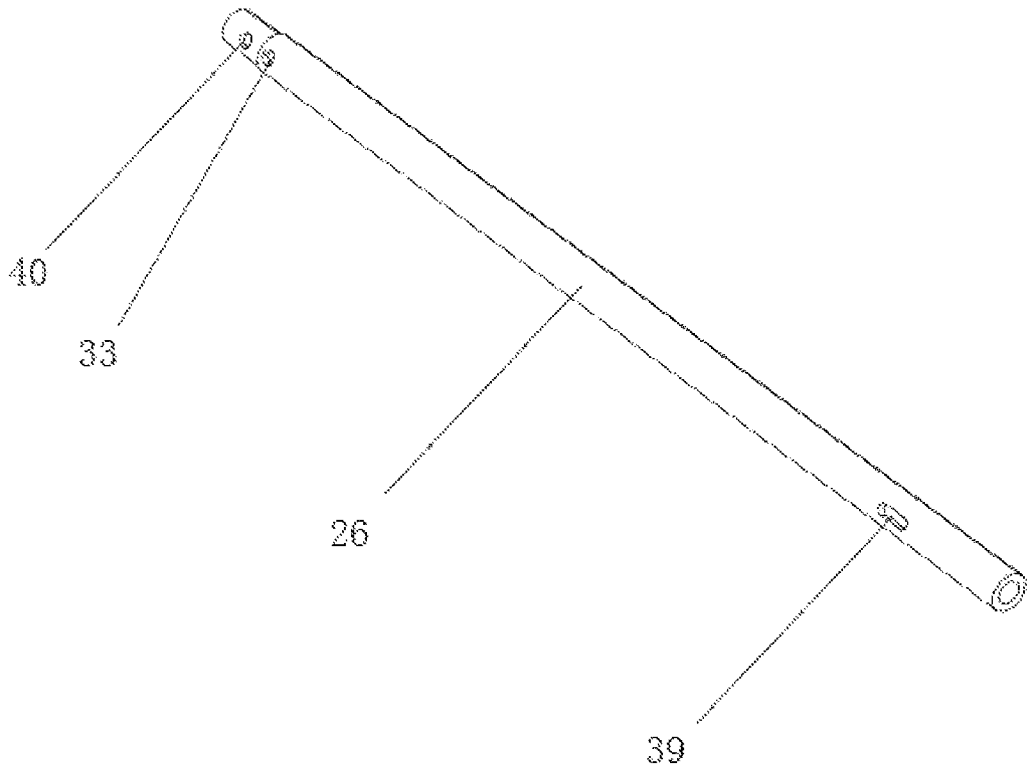
FIG. 10 is a schematic structural view of an inner tube of the embodiment of the present invention.
Figure 11:
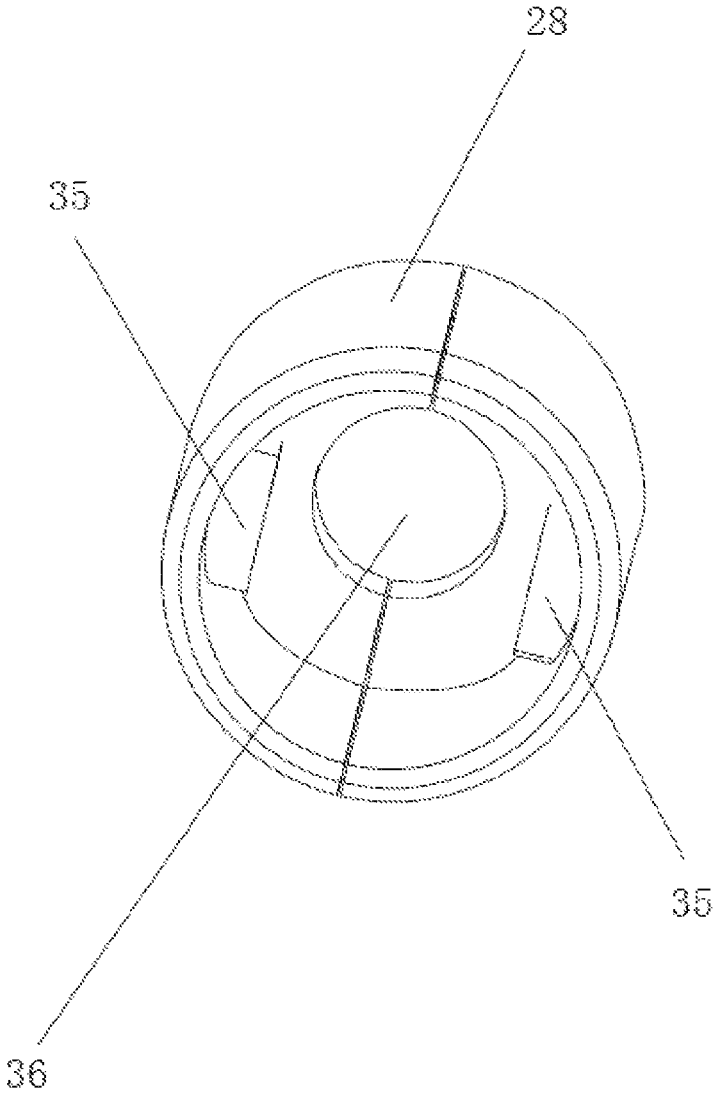
FIG. 11 is a schematic structural view of an inner rod bush of the embodiment of the present invention.

Reference numerals: 1 upper mounting seat, 2 lower mounting seat, 3 support leg, 4 inclined guide hole, 5 mounting through hole, 6 avoidance hole, 7 limiting portion, 8 lock/unlock screw cap, 9 center rod, 10 limiting head, 11 special-shaped connecting block, 12 threaded locking member, 13 first threaded hole, 14 second threaded hole, 15 special-shaped locating hole, 16 expanded blocking portion, 17 sliding slot, 18 first locating slot, 19 second locating slot, 20 slider, 21 elastic limiting member, 22 rubber foot, 23 protective bottom cover, 24 metal sheet, 25 outer tube, 26 inner tube, 27 push rod, 28 inner rod bush, 29 compression spring, 30 conical member, 301 conical head, 302 central shaft, 31 limiting tube sleeve, 32 annular groove, 33 accommodating hole, 34 rigid ball, 35 convex column, 36 avoidance through hole, 37 lock/unlock sliding sleeve, 38 sliding rod, 39 sliding hole, 40 mounting hole, 41 lock/unlock icon, 42 elastic member, 43 slotted hole, 44 upper anti-release tube sleeve, 45 lower anti-release tube sleeve.

DESCRIPTION OF EMBODIMENTS

To further illustrate the embodiments, the accompanying drawings are provided in the present invention. These accompanying drawings are a part of the contents disclosed in the present invention that are mainly used to illustrate the embodiments, and can be used in conjunction with the related descriptions in the specification to explain the operation principle of the embodiments. With reference to these contents, those of ordinary skills in the art should be able to understand other possible implementations and advantages of the present invention. Components in the drawings are not drawn to scale, and like component symbols are usually used to represent like components.

Referring to FIG. 1 to FIG. 11, an embodiment of the present invention provides a telescopic folding chair, including a mounting seat assembly and a cushion. The mounting seat assembly includes an upper mounting seat 1 and a lower mounting seat 2 correspondingly fitted up and down. A periphery of a bottom of the upper mounting seat 1 is uniformly hinged with 4 support legs 3. The 4 support legs 3 are rotatably adjustable close to or away from a center of the upper mounting seat 1. A periphery of a top of the lower mounting seat 2 is uniformly hinged with 4 telescopic arm tube sets. The 4 telescopic arm tube sets are rotatably adjustable close to or away from a center of the lower mounting seat 2. The cushion is mounted on the 4 telescopic arm tube sets. The cushion is a mesh fabric, which is convenient for folding and unfolding. The lower mounting seat 2 is uniformly provided with 4 inclined guide holes 4 along a circumferential direction. The inclined guide holes 4 are gradually inclined away from the center of the lower mounting seat 2 from top to bottom. The inclined guide holes 4 and the telescopic arm tube sets are alternately arranged on the periphery of the lower mounting seat 2. The support legs 3 run through the inclined guide holes 4. The upper mounting seat 1 is rotatably provided with a rotary limiting mechanism, and the lower mounting seat 2 is provided with an avoidance hole 6. A bottom of the rotary limiting mechanism is provided with a limiting head 10, and the lower mounting seat 2 is provided with a limiting portion 7 corresponding to a periphery of the avoidance hole 6. The rotary limiting mechanism rotates to control the limiting head 10 to be movably limited by the limiting portion 7. In an extended state, the limiting head 10 runs through the avoidance hole 6 and is rotatably limited by the limiting portion 7, and the upper mounting seat 1 and the lower mounting seat 2 abut against and lock each other up and down; the 4 support legs 3 inclinedly rotate and unfold outwards under the abutting action of the lower mounting seat 2 and the guiding action of the inclined guide holes 4, so as to abut against the ground and form a stable support; and the 4 telescopic arm tube sets inclinedly rotate and unfold outwards under the abutting action of the upper mounting seat 1, thereby driving the cushion to unfold, which is convenient for the user to sit on. In a retracted state, the limiting head 10 is not rotatably limited by the limiting portion 7 and exits the avoidance hole 6, and the upper mounting seat 1 and the lower mounting seat 2 are separated from each other, so that the 4 support legs 3 and the 4 telescopic arm tube sets can inclinedly rotate and retract inwards, thereby completing the folding process. The present invention is simple in structure, and can be controlled and operated by one hand, thus being convenient to operate. Further, the present invention is quick to unfold for use and fold for storage, and high in stability, and thus, can be used by a user safely and conveniently, thereby ensuring the user experience. Moreover, the present invention occupies small space, and thus, is convenient store and carry.

In this embodiment, the avoidance hole 6 is a special-shaped avoidance hole, and the limiting head 10 is a special-shaped limiting head. A shape and a size of a minimum cross section of the avoidance hole 6 are the same as those of a maximum cross section of the limiting head 10; moreover, the minimum cross section of the avoidance hole 6 is at a position of the avoidance hole 6 corresponding to the limiting portion 7, and the maximum cross section of the limiting head 10 is the plane where the limiting head 10 correspondingly contacts and abuts against the limiting portion 7; and the two cross sections may be rectangular or in other special shapes other than a circle. In this way, in the extended state, the limiting head 10 runs through the avoidance hole 6 and is misaligned with the avoidance hole 6 such that the limiting head 10 is rotatably limited by the limiting portion 7, and the upper mounting seat 1 and the lower mounting seat 2 abut against and lock each other up and down; and in the retracted state, the limiting head 10 is aligned with the avoidance hole 6 and exits the avoidance hole 6 such that the limiting head 10 is not rotatably limited by the limiting portion 7, and the upper mounting seat 1 and the lower mounting seat 2 are separated from each other.

Of course, the numbers of the support legs 3 and telescopic arm tube sets are not limited to 4, and other numbers of at least two, for example, 3, are also possible, which is not limited here.

In this embodiment, the rotary limiting mechanism includes a lock/unlock screw cap 8 and a center rod 9. A top end of the center rod 9 is connected with the lock/unlock screw cap 8. The limiting head 10 is located at a bottom end of the center rod 9. The lock/unlock screw cap 8 is rotatably arranged on a top of the upper mounting seat 1. A center of the upper mounting seat 1 is provided with a mounting through hole 5, and the center rod 9 runs through the mounting through hole 5. Specifically, the rotary limiting mechanism further includes a connecting block 11 and a threaded locking member 12. A center of the special-shaped connecting block 11 is provided with a first threaded hole 13, the top end of the center rod 9 is provided with a second threaded hole 14, a center of the lock/unlock screw cap 8 is provided with a special-shaped locating hole 15, the special-shaped connecting block 11 is limited and mounted in the special-shaped locating hole 15, and the threaded locking member 12 is sequentially threadedly connected with the first threaded hole 13 and the second threaded hole 14 so as to fixedly connect the center rod 9 to the lock/unlock screw cap 8. One side of the center rod 9 close to the limiting head 10 is formed with an expanded blocking portion 16. A diameter of the expanded blocking portion 16 is greater than that of the mounting through hole 5, and a top wall of the expanded blocking portion 16 abuts against a bottom wall of the upper mounting seat 1. With this arrangement, the rotary limiting mechanism can be rotatably mounted onto the upper mounting seat 1 quickly and conveniently while avoiding looseness of the lock/unlock screw cap 8 in the axial direction. With the arrangement of the special-shaped connecting block 11 and the special-shaped locating hole 15, the lock/unlock screw cap 8 and the center rod 9 can rotate synchronously, thereby ensuring the control accuracy of extension and retraction of the telescopic folding chair.

In this embodiment, a bottom side of the lock/unlock screw cap 8 is provided with a sliding slot 17, a first locating slot 18 and a second locating slot 19, and a top wall of the upper mounting seat 1 is provided with a slider 20 and an elastic limiting member 21. Specifically, the elastic limiting member 21 includes a spring and a ball connected with each other. The slider 20 is correspondingly in a slide fit with the sliding slot 17; and the elastic limiting member 21 is elastically limited by the first locating slot 18 and the second locating slot 19 respectively to realize movable switching between the extended state and the retracted state. There are two sets of sliders 20 and sliding slots 17 corresponding to each other, and two sets of elastic limiting members 21, first locating slots 18 and second locating slots 19 corresponding to each other to further improve the rotatable limiting accuracy of the lock/unlock screw cap 8, thereby improving the control accuracy of extension and retraction of the telescopic folding chair.

In this embodiment, a bottom end of each of the support legs 3 is provided with a rubber foot 22 so as to form a reliable and stable support on the ground, and a size of the rubber foot 22 is greater than that of the inclined guide hole 4. In this way, in the retracted state, the wall of the inclined guide hole 4 can block and limit the rubber foot 22, thereby preventing the whole support leg 3 from sliding out of the inclined guide hole 4, making the upper mounting seat 1 and the lower mounting seat 2 completely separated from each other. A surface of the lock/unlock screw cap 8 is provided with lock/unlock icons 41. When the lock/unlock screw cap 8 is rotated counterclockwise, the telescopic folding chair is in the unlocked and extended state; and when the lock/unlock screw cap 8 is rotated clockwise, the telescopic folding chair is in the locked and retracted state.

In this embodiment, the telescopic folding chair further includes a protective bottom cover 23 mounted at a bottom of the lower mounting seat 2, which is configured to shield and protect the bottom of the lower mounting seat 2 and also improve the aesthetics. The limiting portion 7 is provided with a metal sheet 24, which is configured to protect the limiting portion 7 and prevent the limiting head 10 and the limiting portion 7 from abrasion after long-time direct contact and limiting fit, thereby prolonging the service life of the present invention.

In this embodiment, the telescopic arm tube sets each include an outer tube 25 and an inner tube 26 slidably and telescopically arranged in the outer tube 25. An elastic conical assembly and a push rod 27 are arranged in the inner tube 26. The elastic conical assembly is elastically and telescopically arranged at a bottom of the inner tube 26, and a top end of the outer tube 25 is sleeved with a limiting tube sleeve 31. An inner wall of the limiting tube sleeve 31 is formed with an annular groove 32. The bottom of the inner tube 26 is provided with an accommodating hole 33 at a position corresponding to the elastic conical assembly. A rigid ball 34 is arranged in the accommodating hole 33, and the push rod 27 is configured to control the elastic conical assembly to extend and retract in the inner tube 26, such that the rigid ball 34 is movably limited by the annular groove 32. The elastic conical assembly includes an inner rod bush 28, a compression spring 29 and a conical member 30. The inner rod bush 28 is sleeved on a periphery of the bottom of the inner tube 26. The inner rod bush 28 is provided with an avoidance through hole 36. The conical member 30 includes a conical head 301 and a central shaft 302. The central shaft 302 runs through the avoidance through hole 36. The compression spring 29 is sleeved outside the central shaft 302, and two ends of the compression spring 29 respectively abut against an inner bottom wall of the inner rod bush 28 and the conical head 301. The conical head 301 tapers from the central shaft 302 toward the push rod 27. According to the above technical solution, when it is required to slidably retract the inner tube 26 into the outer tube 25, the push rod 27 is driven to move downwards, thereby pushing the conical member 30 to move downwards. The compression spring 29 is compressed, and the rigid ball 34 moves inwards under the guiding action of the conical surface of the conical head 301, so that the rigid ball is not limited by the annular groove 32. Then, the inner tube 26 is pushed downwards, so that the inner tube 26 can be slidably retracted into the outer tube 25. When it is required to slidably extend the inner tube 26 out of the outer tube 25, the inner tube 26 is slidably pulled out to the end of the stroke. Then, the push rod 27 is pulled upward, and the conical member 30 moves up it its original position under the action of the elastic force of the compression spring 29, so that the rigid ball 34 moves outwards under the guiding action of the conical surface of the conical head 301. Thus, the rigid ball 34 is limited by the annular groove 32, thereby realizing extension, limiting and fixation between the inner tube 26 and the outer tube 25.

In this embodiment, when the telescopic arm tube set is in the extended state, the length formed by the outer tube 25 and the inner tube 26 is greater than twice the length of the support leg 3. In the extended state, an included angle between the telescopic arm tube set and the central axis of the present invention is in the range of 10°-50°, and an included angle between the support leg and the central axis of the present invention is in the range of 10°-70°, thereby ensuring the supporting effect; and in the retracted state, the included angle between the telescopic arm tube set/the support leg and the central axis of the present invention is less than 10°, so that the telescopic folding chair can be stored conveniently.

In this embodiment, there are two rigid balls 34 arranged oppositely. Of course, the number of the rigid balls 34 may also be three or one, and can be properly adjusted according to the size of the inner tube 26, which is not limited here.

In this embodiment, the inner rod bush 28 includes a first inner rod bush and a second inner rod bush assembled with each other. Opposite sides of the first inner rod bush and the second inner rod bush are respectively provided with convex columns 35. Two opposite sides of the bottom of the inner tube 26 are respectively provided with mounting holes 40. The convex columns 35 are correspondingly fitted with the mounting holes 40. This arrangement ensures the elastic conical assembly to be assembled to the bottom of the inner tube 26 conveniently and stably.

In this embodiment, the telescopic folding chair further includes a lock/unlock sliding sleeve 37 sleeved outside the inner tube 26. Two opposite sides of the inner tube 26 are respectively provided with sliding holes 39. A top of the push rod 27 is provided with a sliding rod 38, and the sliding rod 38 protrudes out of the sliding hole 39 and is connected with the lock/unlock sliding sleeve 37. With this arrangement, the user can slidably extend and retract the telescopic arm tube sets conveniently.

Figure 12:
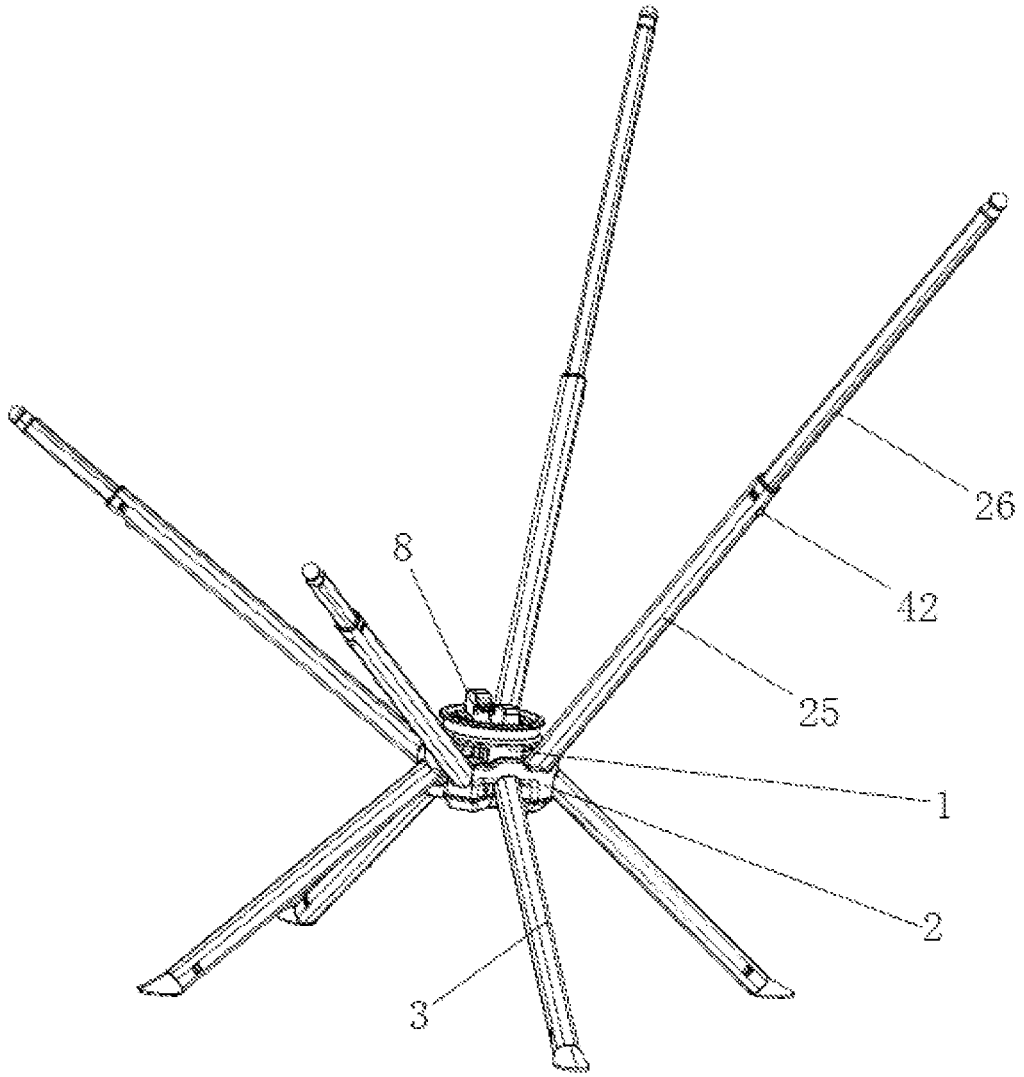
FIG. 12 is a schematic view of another embodiment of the present invention in an extended state.
Figure 13:
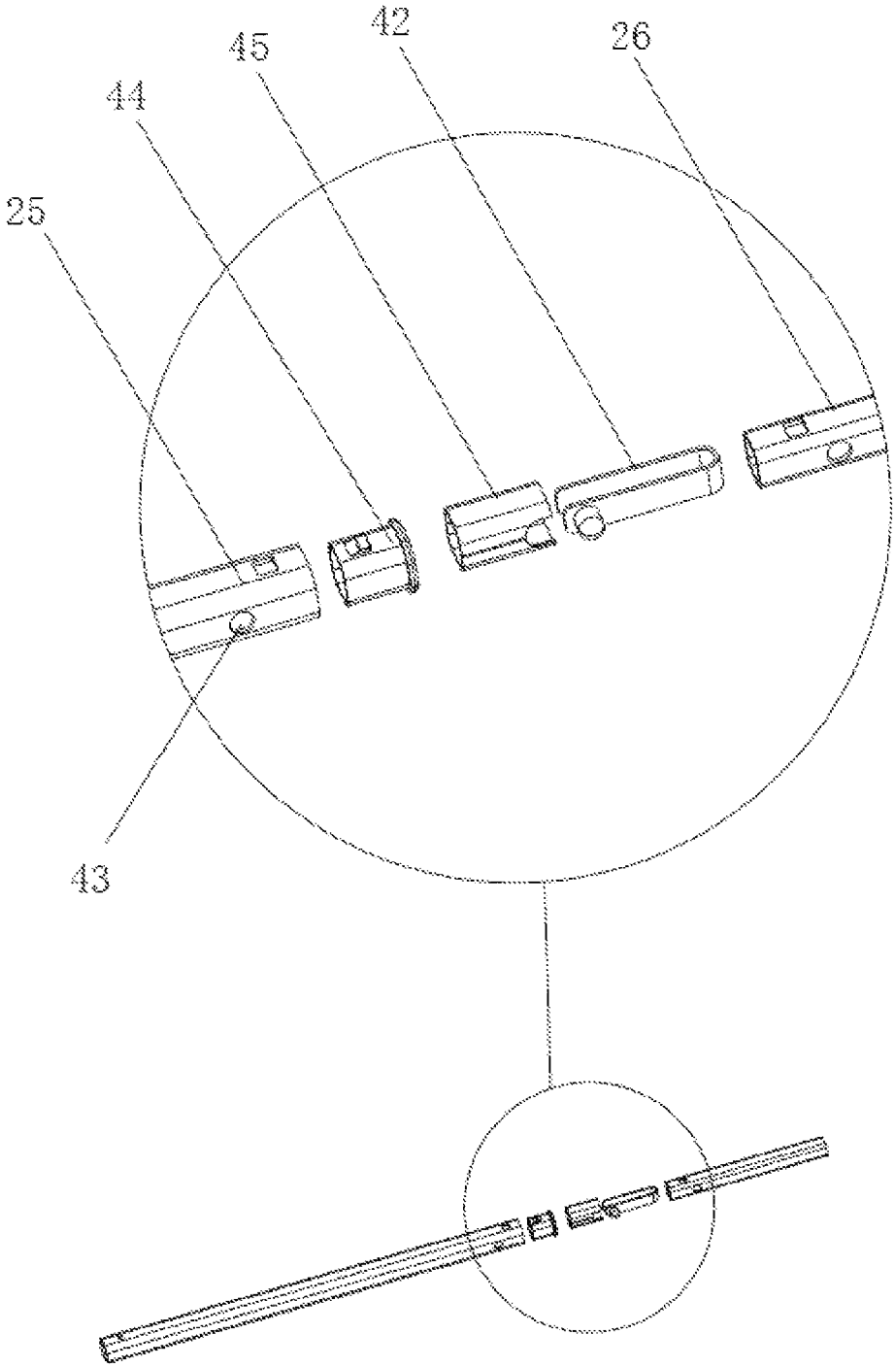
FIG. 13 is a schematic exploded view of a telescopic arm tube set of another embodiment of the present invention.
Figure 14:
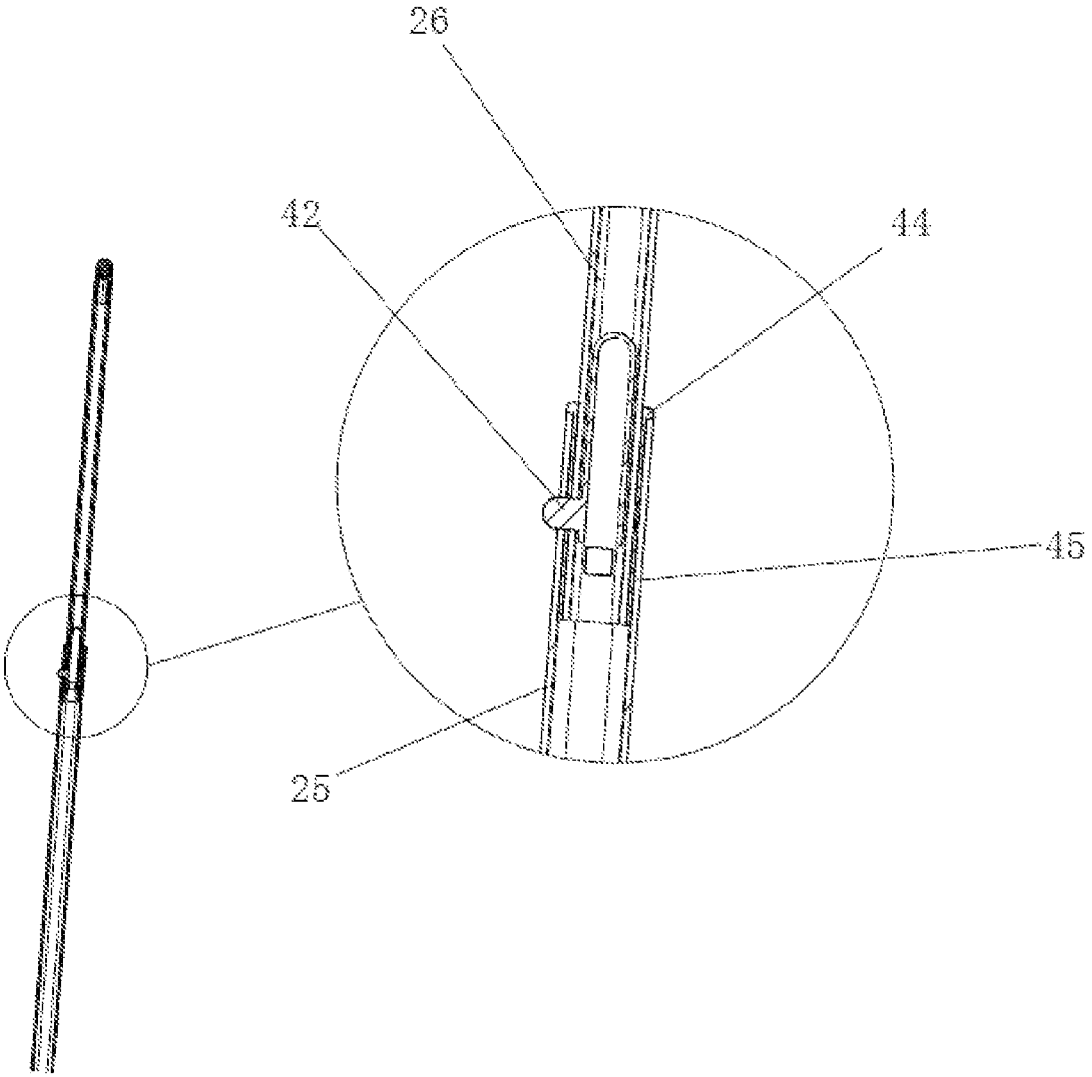
FIG. 14 is a cutaway view of a telescopic arm tube set of another embodiment of the present invention in the extended state.

Referring to FIG. 12 to referring to 14, another embodiment of the present invention further provides a telescopic folding chair, which is different from the above embodiment in that: the telescopic arm tube sets each include an outer tube 25 and an inner tube 26 slidably and telescopically arranged in the outer tube 25. A bottom of the inner tube 26 is provided with an elastic member 42, the outer tube 25 is provided with a slotted hole 43, and the elastic member 42 is in a movable fit with the slotted hole 43 such that the inner tube 26 is slidably and telescopically arranged in the outer tube 25. The elastic member 42 has an elastic column. The elastic column can protrude out of the slotted hole 43, so that the inner tube 26 can be in the extended state stably. When the user applies an external force to press the elastic column back into the slotted hole 43, the inner tube 26 can be slidably retracted into the outer tube 25.

A top end of the outer tube 25 is sleeved with an upper anti-release tube sleeve 44 corresponding to an outside of the inner tube 26, and a bottom end of the inner tube 26 is sleeved with a lower anti-release tube sleeve 45 corresponding to an inside of the outer tube 25; and the upper anti-release tube sleeve 44 is configured to block and limit the lower anti-release tube sleeve 45, thereby preventing the inner tube 26 from sliding out of the outer tube 25.

Although the present invention has been specifically shown and described in connection with the preferred implementations, it should be understood by those skilled in the art that various changes made thereto in forms and details without departing from the spirit and scope of the present invention as defined in the appended claims shall fall within the scope of protection of the present invention.

The invention claimed is:

1. A telescopic folding chair, comprising a mounting seat assembly and a cushion, wherein the mounting seat assembly comprises an upper mounting seat and a lower mounting seat correspondingly fitted up and down; a periphery of a bottom of the upper mounting seat is hinged with a plurality of support legs, and a periphery of a top of the lower mounting seat is hinged with a plurality of telescopic arm tube sets; the cushion is mounted on the plurality of telescopic arm tube sets; the lower mounting seat is provided with a plurality of inclined guide holes along a circumferential direction, and the plurality of support legs run through the plurality of inclined guide holes; the upper mounting seat is rotatably provided with a rotary limiting mechanism, and the lower mounting seat is provided with an avoidance hole; a bottom of the rotary limiting mechanism is provided with a limiting head, and the lower mounting seat is provided with a limiting portion corresponding to a periphery of the avoidance hole; the rotary limiting mechanism rotates to control the limiting head to be movably limited by the limiting portion; in an extended state, the limiting head runs through the avoidance hole and is rotatably limited by the limiting portion, and the upper mounting seat and the lower mounting seat abut against and lock each other up and down; and in a retracted state, the limiting head is not rotatably limited by the limiting portion and exits the avoidance hole, and the upper mounting seat and the lower mounting seat are separated from each other.

2. The telescopic folding chair according to claim 1, wherein a shape and a size of a minimum cross section of the avoidance hole are the same a shape and a size of a maximum cross section of the limiting head; in the extended state, the limiting head runs through the avoidance hole and is misaligned with the avoidance hole such that the limiting head is rotatably limited by the limiting portion, and the upper mounting seat and the lower mounting seat abut against and lock each other up and down; and in the retracted state, the limiting head is aligned with the avoidance hole and exits the avoidance hole such that the limiting head is not rotatably limited by the limiting portion, and the upper mounting seat and the lower mounting seat are separated from each other.

3. The telescopic folding chair according to claim 1, wherein the rotary limiting mechanism comprises a lock/unlock screw cap and a center rod, a top end of the center rod is connected with the lock/unlock screw cap, the limiting head is located at a bottom end of the center rod, the lock/unlock screw cap is rotatably arranged on a top of the upper mounting seat, a center of the upper mounting seat is provided with a mounting through hole, and the center rod runs through the mounting through hole.

4. The telescopic folding chair according to claim 3, wherein the rotary limiting mechanism further comprises a connecting block and a threaded locking member, wherein a center of the connecting block is provided with a first threaded hole, the top end of the center rod is provided with a second threaded hole, a center of the lock/unlock screw cap is provided with a locating hole, the connecting block is limited and mounted in the locating hole, and the threaded locking member is sequentially threadedly connected with the first threaded hole and the second threaded hole so as to fixedly connect the center rod to the lock/unlock screw cap; and one side of the center rod close to the limiting head is formed with an expanded blocking portion, a diameter of the expanded blocking portion being greater than that of the mounting through hole, and a top wall of the expanded blocking portion abutting against a bottom wall of the upper mounting seat.

5. The telescopic folding chair according to claim 3, wherein a bottom side of the lock/unlock screw cap is provided with a sliding slot, a first locating slot and a second locating slot, and a top wall of the upper mounting seat is provided with a slider and an elastic limiting member; the slider is correspondingly in a slide fit with the sliding slot; and the elastic limiting member is elastically limited by the first locating slot and the second locating slot respectively to realize movable switching between the extended state and the retracted state.

6. The telescopic folding chair according to claim 3, wherein a bottom end of each of the plurality of support legs is provided with a rubber foot, and a surface of the lock/unlock screw cap is provided with lock/unlock icons.

7. The telescopic folding chair according to claim 1, further comprising a protective bottom cover mounted at a bottom of the lower mounting seat, wherein the limiting portion is provided with a metal sheet.

8. The telescopic folding chair according to claim 1, wherein the plurality of telescopic arm tube sets each comprise an outer tube and an inner tube slidably and telescopically arranged in the outer tube, wherein an elastic conical assembly and a push rod are arranged in the inner tube; the elastic conical assembly is elastically and telescopically arranged at a bottom of the inner tube, and a top end of the outer tube is sleeved with a limiting tube sleeve; an inner wall of the limiting tube sleeve is formed with an annular groove; the bottom of the inner tube is provided with an accommodating hole at a position corresponding to the elastic conical assembly; and a rigid ball is arranged in the accommodating hole, and the push rod is configured to control the elastic conical assembly to extend and retract in the inner tube, such that the rigid ball is movably limited by the annular groove.

9. The telescopic folding chair according to claim 8, wherein the elastic conical assembly comprises an inner rod bush, a compression spring and a conical member, wherein the inner rod bush is sleeved on a periphery of the bottom of the inner tube; the inner rod bush is provided with an avoidance through hole; the conical member comprises a conical head and a central shaft; the central shaft runs through the avoidance through hole; the compression spring is sleeved outside the central shaft, and two ends of the compression spring respectively abut against an inner bottom wall of the inner rod bush and the conical head; and the conical head tapers from the central shaft toward the push rod.

10. The telescopic folding chair according to claim 8, further comprising a lock/unlock sliding sleeve sleeved outside the inner tube, wherein the inner tube is further provided with sliding holes, a top of the push rod is provided with a sliding rod, and the sliding rod protrudes out of the sliding holes and is connected with the lock/unlock sliding sleeve.

11. The telescopic folding chair according to claim 1, wherein the plurality of telescopic arm tube sets each comprise an outer tube and an inner tube, wherein a bottom of the inner tube is provided with an elastic member, the outer tube is provided with a slotted hole, and the elastic member is in a movable fit with the slotted hole such that the inner tube is slidably and telescopically arranged in the outer tube.

12. The telescopic folding chair according to claim 11, wherein a top end of the outer tube is sleeved with an upper anti-release tube sleeve corresponding to an outside of the inner tube, and a bottom end of the inner tube is sleeved with a lower anti-release tube sleeve corresponding to an inside of the outer tube; and the upper anti-release tube sleeve is configured to block and limit the lower anti-release tube sleeve.

* * * * *